US006255045B1

(12) United States Patent
Chen et al.

(10) Patent No.: US 6,255,045 B1
(45) Date of Patent: Jul. 3, 2001

(54) COLOR PHOTOGRAPHIC ELEMENT CONTAINING IMPROVED POLYMERIC DISULFONAMIDOPHENOL FOR SCAVENGING OXIDIZED DEVELOPER

(75) Inventors: Tienteh Chen, Penfield; Stephen P. Singer, Spencerport; Ronald E. Leone, Rochester, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/523,841

(22) Filed: Mar. 13, 2000

(51) Int. Cl.[7] ..... G03C 1/73
(52) U.S. Cl. ..... 430/629
(58) Field of Search ..... 430/629

(56) References Cited

U.S. PATENT DOCUMENTS

| | | | |
|---|---|---|---|
| 3,700,453 | 10/1972 | Kuechel | 430/505 |
| 3,770,431 | 11/1973 | Gates, Jr. et al. | 430/214 |
| 4,175,968 | 11/1979 | Credner et al. | 430/559 |
| 4,205,987 | 6/1980 | Erikson et al. | 430/216 |
| 4,474,874 | 10/1984 | Hirano et al. | 430/551 |
| 4,717,651 | 1/1988 | Ohki et al. | 430/551 |
| 4,732,845 | 3/1988 | Keiji et al. | 430/551 |
| 4,923,787 | 5/1990 | Harder | 430/489 |
| 5,478,712 | 12/1995 | Singer et al. | 430/551 |
| 5,561,036 | 10/1996 | Singer et al. | 430/551 |
| 5,856,072 | 1/1999 | Leone et al. | 430/372 |
| 5,932,407 | 8/1999 | Begley et al. | 430/544 |

*Primary Examiner*—Hoa Van Le
(74) *Attorney, Agent, or Firm*—Sarah Meeks Roberts

(57) ABSTRACT

This invention relates to a photographic element comprising a support, a radiation sensitive silver halide emulsion layer and a water dispersible polymeric disulfonamidophenol that is substantially immobile in the element. The invention provides color photographic elements that exhibit improved stability, color reproduction and robustness in terms of processing variations; particularly variations in red density due to sensitizing dye.

16 Claims, No Drawings

COLOR PHOTOGRAPHIC ELEMENT CONTAINING IMPROVED POLYMERIC DISULFONAMIDOPHENOL FOR SCAVENGING OXIDIZED DEVELOPER

FIELD OF THE INVENTION

This invention relates to photographic elements containing an improved class of polymeric scavengers for oxidized developer.

BACKGROUND OF THE INVENTION

It is known in the art to add a scavenger for oxidized developer to a photographic element in order to prevent oxidized developing agent from reacting within the element at an undesired location or at an undesired point in time. In particular, it is undesirable for oxidized developer to diffuse away from the imaging layer in which it formed and into other color records where it can form dye in the wrong layer. In some formats early formation of dye can have an undesirable impact on tone scale and fog formation. Typically, scavengers reduce or eliminate oxidized developers without forming any permanent dyes. They also do not cause stains nor release fragments that have photographic activity. They are also typically rendered substantially immobile in the element by incorporation of an anti-diffusion group (a ballast) or by attachment to a polymer backbone. Mobility of an oxidized developer scavenger within the film element is undesirable because it may scavenge the oxidized developer in a layer where the oxidized developer is required; i.e. in an imaging layer. Ideally, the scavenger should be present only in those areas of the film element where the presence of oxidized developer is detrimental.

Known scavengers for oxidized developers include ballasted para hydroquinone (1,4-dihydroxybenzene) compounds such as described in U.S. Pat. No. 3,700,453 or U.S. Pat. No. 4,732,845; ballasted gallic acid (1,2,3-trihydroxybenzene) compounds as described in U.S. Pat. No. 4,474,874; ballasted resorcinol (1,3-dihydroxybenzene) compounds as described in U.S. Pat. Nos. 3,770,431 and 5,856,072; ballasted hydrazides such as described in U.S. Pat. No. 4,923,787 and ballasted pyrocatechol (1,2-dihydroxybenzene) compounds as described in U.S. Pat. Nos. 4,175,968, 5,561,036 and German Patent No. 766,135 and couplers which do not form permanent dyes such as those described in U.S. Pat. No. 5,932,407.

Such known materials are insufficient in their activity and require high material usage, thus increasing cost, storage and handling concerns. High material usage also requires thicker layers which degrade sharpness through increased scatter pathlength. In addition, because some of these known materials are sensitive to oxidative conditions, they are often insufficiently stable upon long term storage. Finally, many of these materials form stains or colored residues during processing. Therefore, it is desirable to find scavengers for oxidized developers that have high activity, have excellent stability upon long-term storage and do not leave colored residues after processing.

Disulfonamidophenyl scavengers for oxidized developing agents are described in U.S. Pat. No. 4,447,523. Ballasted sulfonamidophenols as scavengers for oxidized electron transfer agents are described in U.S. Pat. No. 4,205,987. Polymeric sulfonamidophenols as scavengers are described in U.S. Pat. No. 4,717,651. A particular deficiency associated with the use of sulfonaminophenols as scavengers in photographic systems is that they can cause increased sensitizing dye stain. Sensitizing dyes are ordinarily intended to be washed out or otherwise removed from the photographic element during processing. However, in many cases sensitizing dye is not fully removed but is retained in the photographic element after processing. This leads to a non-imagewise increases in Dmin because the retained sensitizing dye is colored (although shifted in hue). In particular, red sensitizing dyes often exist in two forms in photographic elements, monomeric (magenta colored, □max=580 nm) and aggregated (cyan colored, □max=640 nm). Normally, retained red sensitizing dye exists in its monomeric form (magenta colored) and leads to non-imagewise increases in green density. In the presence of a sulfonamidophenol compound, retained red sensitizing dye can aggregate and become cyan colored. After development, there is a positive image in residual sulfonamidophenol. In areas of the element where there is no exposure, there is no oxidized developer to consume the scavenger, whereas at areas of high exposure, all of the sulfonamidophenol is consumed. Thus, the retained red sensitizing dye will form a corresponding positive image in its aggregated form (cyan in color) along with the corresponding positive scale in red density. This causes an undesirable increase in red Dmin and an effective loss in red contrast and speed when the red Dmin is adjusted back to the aim level. This deficiency is a particular problem whenever high levels of red sensitizing dyes are used, as is commonly the case with tabular silver halide emulsions and other emulsions with high surface area. It is also a particular problem with sensitizing dyes that are especially prone to aggregate in the presence of a sulfonamidophenol.

Known sulfonamidophenol scavengers are still deficient in this area U.S. Pat. No. 5,478,712 describes a combination of a disulfonamidophenol scavenger with ballasted amines of high basicity to avoid sensitizing dye stain which is an improvement, but not to the necessary degree.

It is the object of this invention to provide a novel photographic element containing a polymeric disulfonamidophenol scavenger of oxidized developer that is active, inexpensive, and oxidatively stable. The scavenger must not produce unwanted stains after processing and should have no photographic effects other than the scavenging of oxidized developer.

SUMMARY OF THE INVENTION

This invention provides a photographic element comprising a support, a radiation sensitive silver halide emulsion layer and a water dispersible polymeric disulfonamidophenol that is substantially immobile in the element. The photographic elements of the invention exhibit improved stability, color reproduction and robustness in terms of processing variations. Particularly the photographic elements of the invention have fewer variations in red density due to sensitizing dye.

DETAILED DESCRIPTION OF THE INVENTION

The polymeric disulfonamidophenol utilized in the invention may be any disulfonamidophenol polymer which is suitable for use in a photographic element and which is water dispersible and substantially immobile in the photographic element as described hereafter. In one embodiment the water dispersible disulfonamidophenol polymers of the invention have repeating units according to Formula A:

(A)

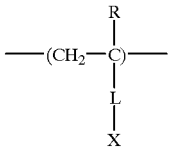

wherein:

R is hydrogen or an alkyl or aryl group; L is a divalent linking and X is a disulfonamidophenol. They can also be described as being derived from a monomer defined by the following general formula (A'):

(A')

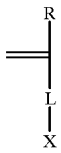

where R, L and X are the same as for (A).

L is a divalent linking group that permanently attaches X to the polymeric backbone. Preferably L is —O—, —S—, —NH—, —$Ch_2$—, —$SO_2$— or a substituted or unsubstituted carbonyl or aryl group, or combinations thereof, containing 1 to 20 carbon atoms. Preferred linking groups are represented by Formulas L-1 and L-2:

(L-1)

(L-2)

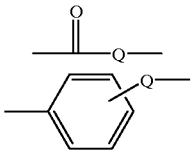

where Q is —O—, —S—, —NH—, —CO—, —$Ch_2$—, —$SO_2NH$— or —$SO_2$—. Examples of particularly preferred linking groups according to Formula L-1 are —CONH— and —$CO_2$—. Especially preferred linking groups according to Formula L-2 are linking groups in which Q is a sulfonamido group in which the nitrogen is attached directly to X. There may be optional groups or atoms, such as alkylene groups, that attach Q to X. Some examples of these extended linking groups would be —$CONHCH_2CH_2CONH$—X, —$CO_2CH_2CH_2$—X, —$CONHCH_2CH_2$—O—$Ch_2CH_2NHCO$—X, etc.

X is a derivative of a disulfonamidophenol which is defined as a phenol or napthol nucleus substituted with at least two sulfonamido (—$NHSO_2$—) groups in which the —NH of the sulfonamido groups is attached directly to the phenol or napthol nucleus. The disulfonamidophenol can also be represented either by Formula X-a or X-b:

(X-a)

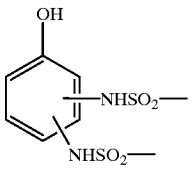

-continued (X-b)

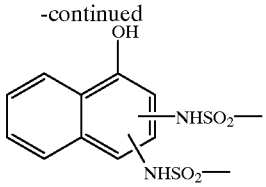

The preferred structure of the disulfonamidophenol is according to Formula X-1:

X-1

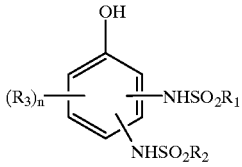

wherein $R_1$ and $R_2$ are alkyl, aryl, amino, —O-alkyl, —S-alkyl, —O-aryl or S-aryl groups and may be the same or different; $R_3$ is an alkyl, aryl, alkoxy or aryloxy, alkylthio or arylthio, sulfoxyl, sulfonyl, sulfamoyl

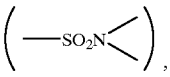

sulfonic acid, cyano, nitro, —O—CO—, or —O—$SO_2$— group, a heterocyclic group such as furanyl or morpholino, a carbonyl group such as keto, a carboxylic acid (—$CO_2H$), carboxylate ester (—$CO_2$—), or carbamoyl

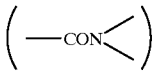

group, an amino group such as a primary, secondary or tertiary substituted nitrogen, a carbonamido (>NCO—) or sulfonamido (>$NSO_2$—) group or a halo such as fluoro, chloro, bromo or iodo; and n=0,1,2 or 3. One of $R_1$, $R_2$ and $R_3$ is a L group that serves to attach the nucleus to the polymeric backbone.

More preferred are compounds according to Formula X-2:

(X-2)

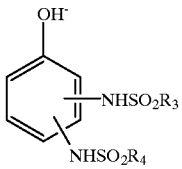

where $R_3$ and $R_4$ are alkyl or aryl groups, most preferably aryl groups, and may be the same or different. One of $R_3$ or $R_4$ must be a L group that serves to attach the nucleus to the polymeric backbone.

Most preferred are 2,4-disulfonamidophenols according to Formula X-3:

(X-3)

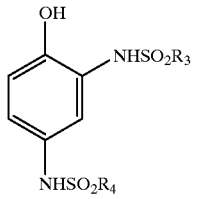

where $R_3$ and $R_4$ are alkyl or aryl groups, most preferably aryl groups, and may be the same or different. One of $R_3$ or $R_4$ must be a L group that serves to attach the nucleus to the polymeric backbone.

The key feature of the polymers of the invention is that they are water dispersible. By water dispersible, it is meant that the polymer is at least partially water soluble due to the presence of groups that are fully or substantially (greater than 50%) ionized in water at pH 7. Examples of groups that are fully or substantially ionized in water and confer water dispersibility to the polymer are sulfonic acids, carboxylic acids, phosphonic acids or nitrogen acids with pKa of 7.0 or less such as imides (—CO—NH—CO—), sulfimides (—SO2—NH—SO2—) or acylsulfonamides (—CO—NH—SO2—). Preferred are polymers that contain sulfonic or carboxylic acid groups.

Although the disulfonamidophenol monomer may be directly substituted with the ionizing group, it is preferred to adjust the water solubility of the polymers by using an ionizable comonomer. It is preferred that the polymers of the invention contain from 5 to 50 weight percent of the ionizable comonomer. Ionizable monomers contain an ionizable functional group selected from the group consisting of sulfonates, sulfates, phosphates, and carboxylic acids, with sulfonates and sulfates being particularly preferred. The repeating units of the polymer can be represented by the general formula (B) and are derived from the corresponding ionizable comonomer as in general formula (B'):

(B)

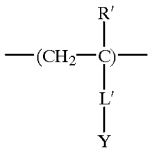

(B')

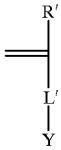

where R' is hydrogen or an alkyl or aryl group, L' is a divalent linking group as defined before (as L) and Y is an ionizable subunit such as a sulfonate, sulfate, phosphate, carboxylate, thiosulfate or sulfinate, with sulfonate and sulfate being particularly preferred. Suitable ionic monomers include acrylic acid and its derivatives such as alpha-chloroacrylic acid and alpha-alkylacrylic acid (such as methacrylic acid, etc.) or other vinylous acids such as itaconic acid, citraconic acid or crotonic acid, as well as, but not limited to, the following:

IM-1:

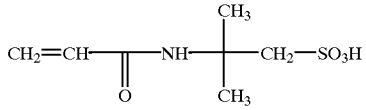

IM-2:

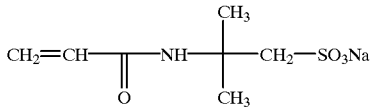

IM-3:

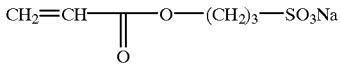

IM-4:

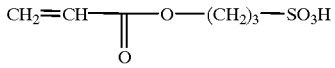

IM-5:

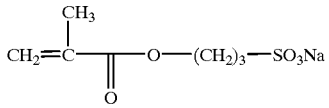

IM-6:

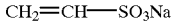

IM-7:

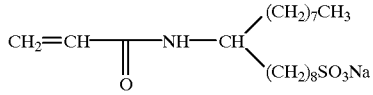

IM-8:

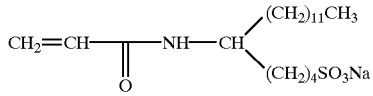

IM-9:

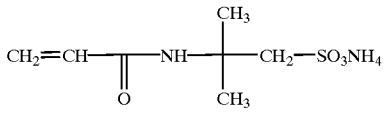

IM-10:

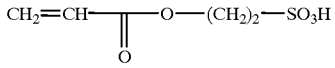

IM-11:

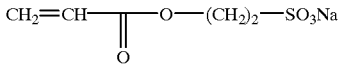

IM-12:

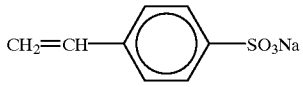

IM-13:

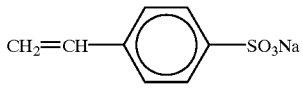

IM-14:

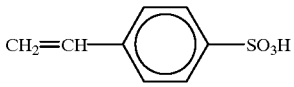

IM-15:

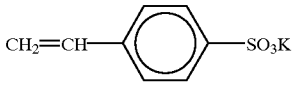

-continued

IM-16:

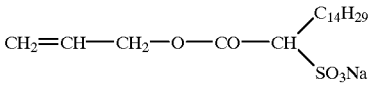

IM-17:

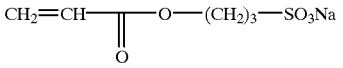

Optionally, a third monomer can be used to additionally adjust the hydrophobicity and Glass Transition Temperature (Tg) of the polymers. Monomers suitable for this application include an ester or amide derived from an acrylic acid or one of its derivatives (for example, acrylamide, methacrylamide, n-butylacrylamide, t-butylacrylamide, diacetone acrylamide, methyl acrylate, ethyl acrylate, n-propyl acrylate, n-butyl acrylate, ter-butyl acrylate, isobutyl acrylate, 2-ethylhexyl acrylate, n-octyl acrylate, lauryl acrylate, tetrahydrofuryl acrylate, methyl methacrylate, ethyl methacrylate, n-butyl methacrylate, beta-hydroxy methacrylate, tetrahydrofuryl methacrylate, etc.), a vinyl ester(for example, vinyl acetate, vinyl propionate, vinyl laurate, etc.), acrylonitrile, methacrylonitrile, an aromatic vinyl compound (for example, styrene or a derivative thereof, vinyl toluene, divinyl benzene, vinyl acetophenone, etc.), vinylidene chloride, a vinyl alkyl ether (for example, vinyl ethyl ether, etc.), an ester of maleic acid, N-vinyl-2-pyrrolidone, N-vinylpyridine, 2- or 4-vinylpyridine, etc. Of these monomers, an ester of acrylic acid, an ester of methacrylic acid, and styrene and styrene derivatives are particularly preferred. Two or more ethylenic unsaturated monomers can be used together. For example, a combination of methyl acrylate and butyl acrylate, ethyl acrylate and styrene, tetrahydrofuryl methacrylate and ethyl acrylate, methyl acrylate and ethyl acrylate, etc., can be used.

When more than two monomers are present in the polymer, the weight percent of the disulfonamidophenol monomer as defined by Formula (A) is suitably from 10 to 90% and preferably from 20 to 50%. The weight percent of ionic monomer(s) as defined by Formula (B) is suitably from 1 to 90% and preferably from 5 to 50%. The weight percent of a third monomer not defined by Formula (A) and Formula (B) can be from 10 to 50% and preferably from 10 to 30%.

The solubility of the polymer in water is suitably from 0.5% to 50% by weight (25° C.) and preferably from 2.5% to 50%. The architecture of the polymeric scavengers can be random, alternate, block, graft, star or dentritic polymers. The molecular weight of the polymeric scavengers is suitably from 1000 to 1,000,000 and preferably from 3000 to 50,000. Tg of the polymeric scavengers is suitably from −40° C. to 250° C. and preferably from 0 to 200° C.

The polymeric scavenger should be substantially immobilized in the element, preferably through control of the overall hydrophobicity/hydrophilicty or by its molecular weight. By substantially immobilized it is meant that the polymeric scavenger will not migrate from the layer in which it is coated under traditional color negative processing conditions. Such processes are well known to those skilled in the art, such as Kodak C-41™ processing as described in the British Journal of Photography Annual of 1998, pages 191–198, incorporated herein by reference.

The polymer of this invention can be prepared by solution polymerization techniques. Solution polymerization is well known in the art and can be found, for example, in "High Polymers, Vol. X, Polymer Processes", Calvin E. Schildknecht, Ed., Interscience Publishers, Inc. New York (1956), pp. 175–194. Examples of the chemical initiators which may be used include a thermally decomposable initiator, for example, a persulfate (such as ammonium persulfate, potassium persulfate, sodium persulfate), hydrogen peroxide, 4,4'-azobis(4-cyanovaleric acid), 2,2'-azobis (2-methyl-N-(2-hydroxyethyl)propionamide),2,2'-azobis-(2-amidinopropane) dihydrochloride, 2,2'-azobis(N,N'-dimethyleneisobutylramidine), and redox initiators such as hydrogen peroxide-iron(II) salt, potassium persulfate-sodium hydrogensulfate, potassium persulfate-sodium metabisulfite, potassium persulfate-sodium hydrogen bisulfite, cerium salt-alcohol, etc. Suitable solvents for the polymerization include water, methanol, ethanol, propanol, isopropanol, DMF, DMSO, N-methyl pyrrolidone, N,N-dimethylacetamide, ethyleneglycol, diethyleglycol, triethyleneglycol, etc. Two or more solvents can be used together such as methanol/water, and DMF/water, etc. Generally, the appropriately substituted disulfonamidophenol serves as a monomer or a comonomer for the preparation of the polymer, although it is possible to pre-form the polymer backbone and then attach the disulfonamidophenol.

It is desired that the polymeric backbone of the materials of the invention does not undergo any significant amounts (less than 5–10%) of chemical or redox reaction directly with oxidized color developer or other components of the processing solutions. The disulfonamidophenol derivatives are permanently bonded to the polymeric backbone and are not released from the polymeric backbone during processing. The polymers are colorless as coated. The polymeric compounds of the invention are located in the film element as described and are not added to the processing solutions.

In general, scavengers are added at a level necessarily to give the desired degree of improvement and so, the laydowns will depend on the exact needs of the system. When the polymeric disulfonamidophenol scavengers of the invention are used in a non-light sensitive layer, they are typically used at a laydown of $1.0\times10^{-3}$ to $1.0\times10^{-5}$ moles/m$^2$. When used directly in an imaging layer, a typical laydown is from $1\times10^{-4}$ to $1.0\times10^{-6}$ moles/m$^2$. However, the polymers of the invention could be used at higher or lower levels if required.

The following are examples of monomeric disulfonamidophenol compounds that are useful as part of a polymer in this invention:

MS-1:

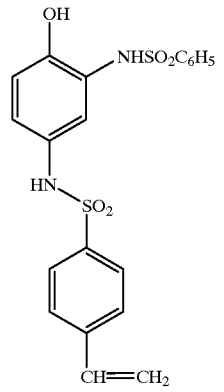

-continued
MS-2:
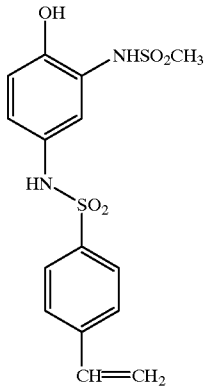
MS-3:
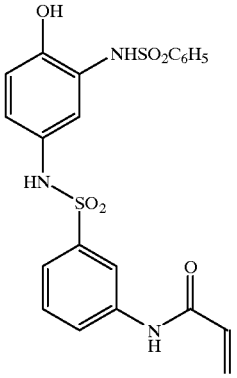
MS-4:
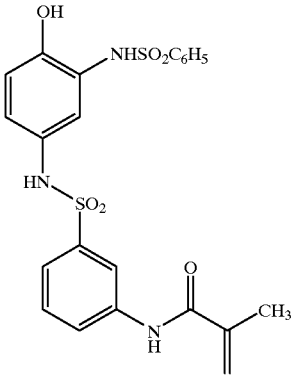
MS-5:
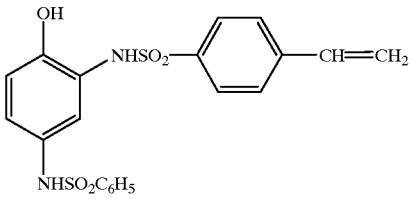
-continued
MS-6:
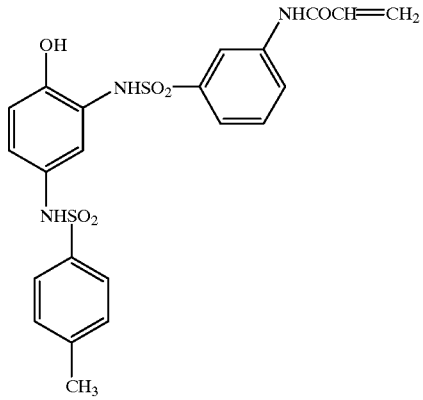
MS-7:
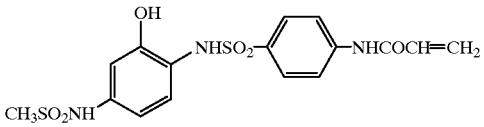
MS-8:
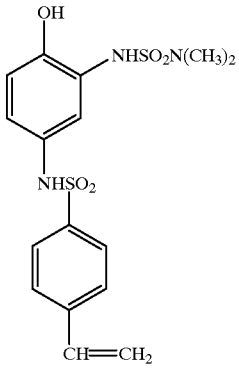
MS-9:
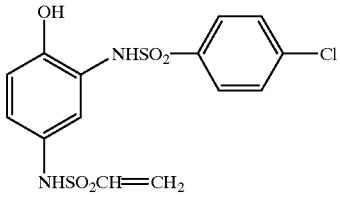
MS-10:
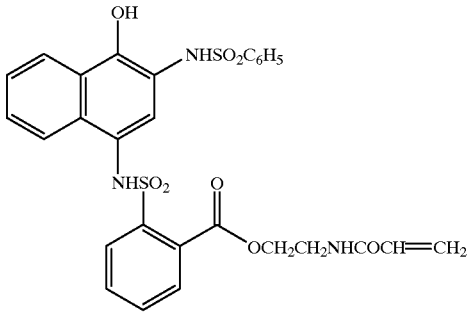

-continued

MS-11:

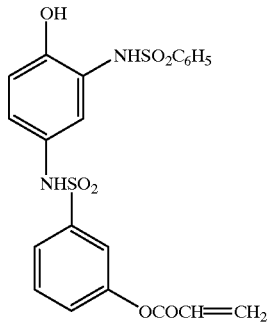

MS-12:

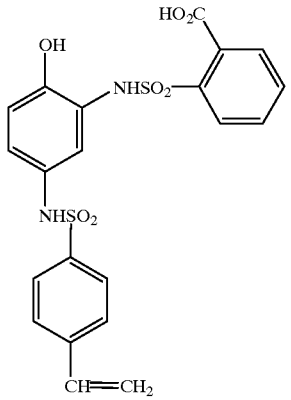

MS-13:

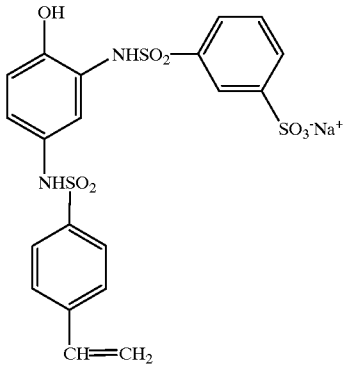

MS-14:

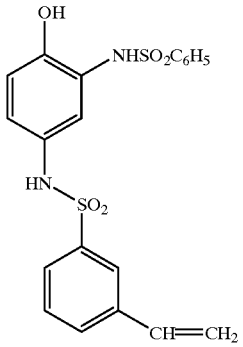

-continued

MS-15:

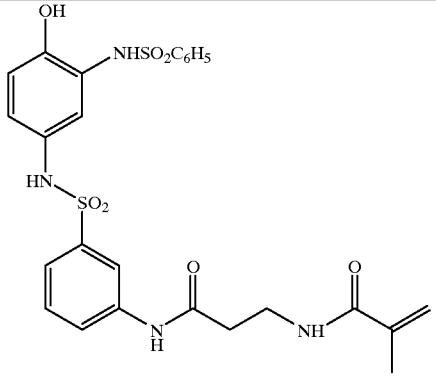

MS-16:

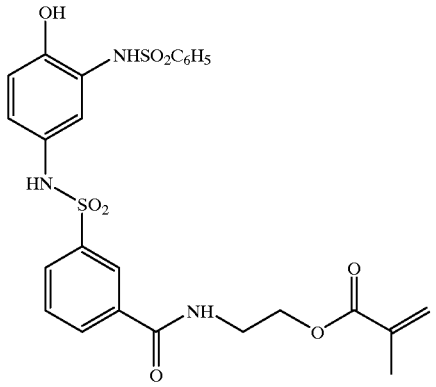

Some examples of the polymeric scavengers of the invention are:

P-1: MS-1/n-Butyl Acrylate/Acrylic acid /IM-12= (1:1:1:0.4) molar ratio.

P-2: MS-1/n-Butyl Acrylate/Acrylic acid /IM-12= (1:1:0.5:0.4) molar ratio.

P-3: MS-1/n-Butyl Acrylate/Acrylic acid /IM-12= (1:2:1:0.4) molar ratio.

P-4: MS-2/n-Butyl Acrylate/Acrylic acid /IM-12= (1:1:1:0.4) molar ratio.

P-5: MS-2/n-Butyl Acrylate/Acrylic acid /IM-12= (1:1:0.5:0.4) molar ratio.

P-6: MS-2/n-Butyl Acrylate/Acrylic acid /IM-12= (1:2:1:0.4) molar ratio.

P-7: MS-1/n-Butyl Acrylate/Acrylic acid /IM-3=(1:1:1:0.4) molar ratio.

P-8: MS-1/n-Butyl Acrylate/Acrylic acid /IM-3= (1:1:0.5:0.4) molar ratio.

P-9: MS-1/n-Butyl Acrylate/Acrylic acid /IM-3=(1:2:1:0.4) molar ratio.

P-10: MS-2/n-Butyl Acrylate/Acrylic acid /IM-3= (1:1:1:0.4) molar ratio.

P-11: MS-2/n-Butyl Acrylate/Acrylic acid /IM-3= (1:1:0.5:0.4) molar ratio.

P-12: MS-2/n-Butyl Acrylate/Acrylic acid /IM-3= (1:2:1:0.4) molar ratio.

P-13: MS-1/n-Butyl Acrylate/Methacrylic acid /IM-12= (1:1:1:0.4) molar ratio.

P-14: MS-1/n-Butyl Acrylate/Methacrylic acid /IM-12= (1:1:0.5:0.4) molar ratio.

P-15: MS-1/n-Butyl Acrylate/Methacrylic acid /IM-12= (1:2:1:0.4) molar ratio.

P-16: MS-3/n-Butyl Acrylate/Acrylic acid /IM-12= (1:1:1:0.4) molar ratio.

P-17: MS-4/n-Butyl Acrylate/Acrylic acid /IM-12= (1:1:1:0.4) molar ratio.

P-18: MS-5/n-Butyl Acrylate/Acrylic acid /IM-12= (1:1:1:0.4) molar ratio.

P-19: MS-6/n-Butyl Acrylate/Acrylic acid /IM-12= (1:1:1:0.4) molar ratio.

P-20: MS-7/n-Butyl Acrylate/Acrylic acid /IM-12= (1:1:1:0.4) molar ratio.

P-21: MS-8/n-Butyl Acrylate/Acrylic acid /IM-12= (1:1:1:0.4) molar ratio.

P-22: MS-9/n-Butyl Acrylate/Acrylic acid /IM-12= (1:1:1:0.4) molar ratio.

P-23: MS-10/n-Butyl Acrylate/Acrylic acid /IM-12= (1:1:1:0.4) molar ratio.

P-24: MS-11/n-Butyl Acrylate/Acrylic acid /IM-12= (1:1:1:0.4) molar ratio.

P-25: MS-12/n-Butyl Acrylate/Acrylic acid /IM-12= (1:1:1:0.4) molar ratio.

P-26: MS-13/n-Butyl Acrylate/Acrylic acid /IM-12= (1:1:1:0.4) molar ratio.

The materials of the invention can be added to a mixture containing gelatin with or without silver halide before coating. In either case, additional components like couplers, doctors, surfactants, hardeners and other materials that are typically present in such solutions may also be present at the same time. The materials of the invention may be added directly if water soluble, dissolved in an organic water miscible solution such as methanol, acetone or the like or added as a latex or suspension. In addition, one or more permanent solvents can be added to the polymer. Some examples of suitable permanent solvents are tricresylphosphate, N,N-diethyllauramide, N,N-dibutyllauramide, p-dodecylphenol, dibutylphthalate, di-n-butyl sebacate, N-n-butylacetanilide, 9-octadecen-1-ol, ortho-methylphenyl benzoate, trioctylamine and 2-ethylhexylphosphate. Preferred classes of solvents are carbonamides, phosphates, alcohols, amines and esters. When a solvent is present, it is preferred that the weight ratio of compound to solvent be at least 1 to 0. 1, or most preferably, at least 1 to 0.5. The materials of the invention may also be dispersed as an admixture with another component of the system such as a coupler so that both are present in the same oil droplet.

The following red sensitizing dyes are also particularly beneficial when used in combination with the polymeric scavengers of the invention:

RSD-1

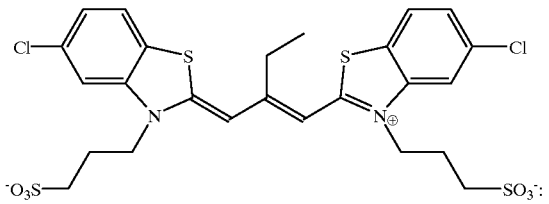

-continued

RSD-2

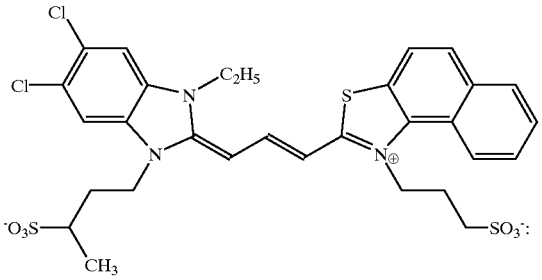

RSD-3

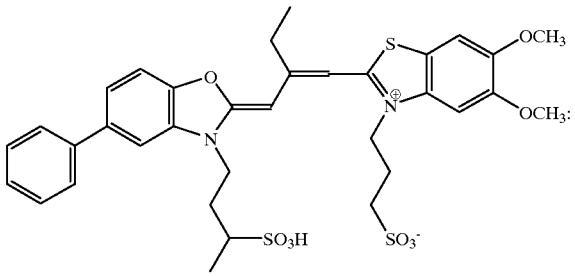

RSD-4

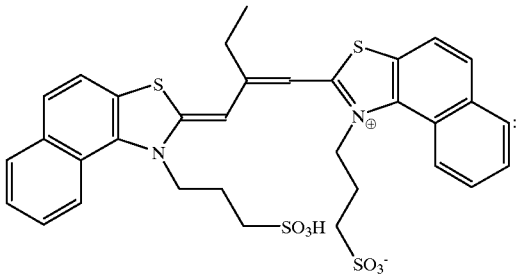

RSD-5

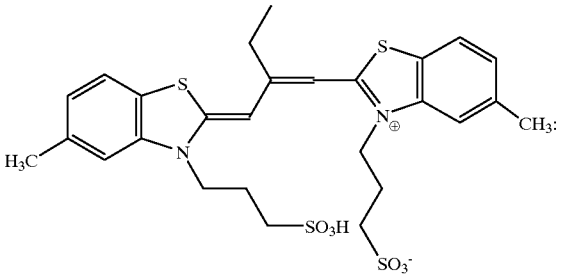

RSD-6

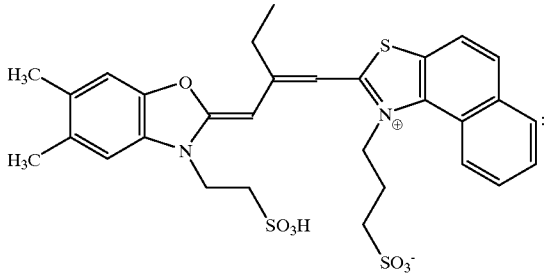

-continued

RSD-7

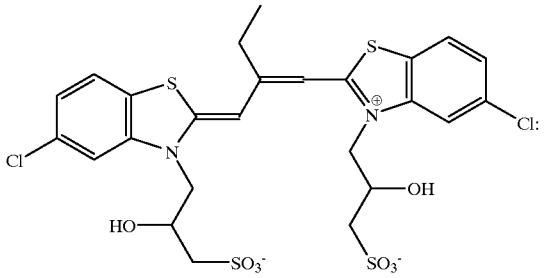

RSD-8

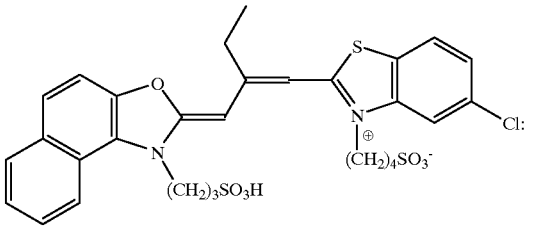

RSD-9

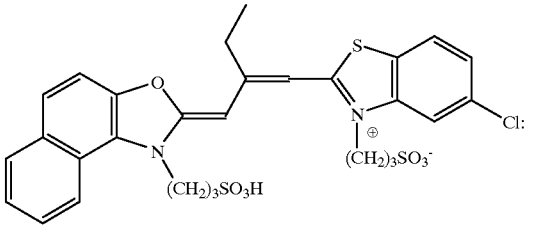

RSD-10

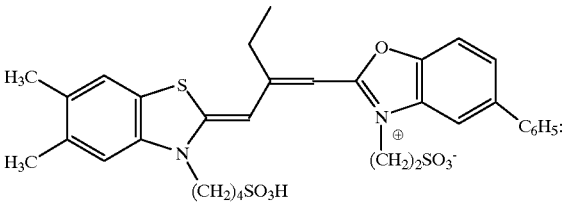

RSD-11

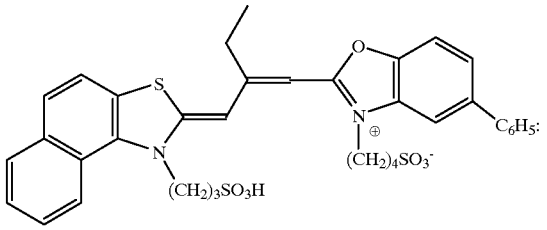

The polymers of the invention are also particularly useful when used in film elements that contain low overall silver levels. Thus, films containing 9 g/m$^2$ of total silver or less, or more preferably 5.4 g/m$^2$ or less or even 4.3 g/m$^2$ or less benefit from the use of the compounds of the invention.

The polymer of the invention can be located in an imaging layer or more suitably, located in a light insensitive layer. Preferably, the light insensitive layer is an interlayer located between two light sensitive imaging layers. The interlayer can be located between two imaging layers sensitive to the same color or different. It is also possible that the interlayer containing the polymer is located between an imaging layer and an antihalation layer. The interlayer may also contain additional materials such as colored organic filter dyes or finely divided silver salts such as Carey-Lea silver. The light insensitive layer may also be an antihalation layer which contains metallic collodial silver or organic dyes.

Unless otherwise specifically stated or when the term "group" is used, it is intended throughout this specification, when a substituent group contains a substitutable hydrogen, it is intended to encompass not only the substituent's unsubstituted form, but also its form further substituted with any group or groups as herein mentioned, so long as the group does not destroy properties necessary for photographic utility. Suitably, a substituent group may be halogen or may be bonded to the remainder of the molecule by an atom of carbon, silicon, oxygen, nitrogen, phosphorous, or sulfur. The substituent may be, for example, halogen, such as chlorine, bromine, iodine or fluorine; nitro; hydroxyl; cyano; carboxyl; or groups which may be further substituted, such as alkyl, including straight or branched chain or cyclic alkyl, such as methyl, trifluoromethyl, ethyl, t-butyl, 3-(2,4-di-t-pentylphenoxy)propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy) ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentyl-phenoxy)acetamido, alpha-(2,4-di-t-pentylphenoxy) butyramido, alpha-(3-pentadecylphenoxy)hexanamido, alpha-(4-hydroxy-3-t-butylphenoxy)tetradecanamido, 2-oxopyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl) carbonylamino, p-dodecyl-phenylcarbonylamino, p-tolylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-tolylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, p-tolylsulfonamido, p-dodecylbenzenesulfonamido, N-methyltetradecylsulfonamido, N,N-dipropyl-sulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4di-t-pentylphenoxy)butyl]carbamoyl, N-methyl-N-tetradecylcarbamoyl, and N,N-dioctylcarbamoyl; acyl, such as acetyl, (2,4di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl; dodecylsulfonyl, hexadecylsulfonyl, phenylsulfonyl, 4-nonylphenylsulfonyl, and p-tolylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-tolylsulfinyl; thio, such as ethylthio, octylthio, benzylthio, tetradecylthio, 2-(2,4-di-t-pentylphenoxy)ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1-(N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups, etc. Generally, the above groups and substituents thereof may include those having up to 48 carbon atoms, typically1 to 36 carbon atoms and usually less than 24 carbon atoms, but greater numbers are possible depending on the particular substituents selected.

To control the migration of various components, it may be desirable to include a high molecular weight or polymeric backbone containing hydrophobic or "ballast" group in molecules. Representative ballast groups include substituted or unsubstituted alkyl or aryl groups containing 8 to 48 carbon atoms. Representative substituents on such groups include alkyl, aryl, alkoxy, aryloxy, alkylthio, hydroxy, halogen, alkoxycarbonyl, aryloxcarbonyl, carboxy, acyl, acyloxy, amino, anilino, carbonamido, carbamoyl, alkylsulfonyl, arylsulfonyl, sulfonamido, and sulfamoyl groups wherein the substituents typically contain 1 to 42 carbon atoms. Such substituents can also be further substituted.

As used herein, the term "color photographic element" means any element containing a light-sensitive silver halide emulsion layer containing an image dye-forming coupler. They can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer. A single color element may comprise a combination of couplers in one or more common layers which upon processing together form a monocolor, including black or gray, (so-called chromogenic black and white) dye image.

A typical color photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, or subbing layers.

If desired, the photographic element can be used in conjunction with an applied magnetic layer as described in *Research Disclosure,* November 1992, Item 34390 published by Kenneth Mason Publications, Ltd., Dudley Annex, 12a North Street, Emsworth, Hampshire P010 7DQ, ENGLAND, and as described in Hatsumi Kyoukai Koukai Gihou No. 94-6023, published Mar. 15, 1994, available from the Japanese Patent Office, the contents of which are incorporated herein by reference. When it is desired to employ the inventive materials in a small format film, *Research Disclosure,* June 1994, Item 36230, provides suitable embodiments.

In the following discussion of suitable materials for use in the emulsions and elements of this invention, reference will be made to *Research Disclosure,* September 1996, Item 38957, available as described above, which is referred to herein by the term "Research Disclosure". The contents of the Research Disclosure, including the patents and publications referenced therein, are incorporated herein by reference, and the Sections hereafter referred to are Sections of the Research Disclosure.

Except as provided, the silver halide emulsion containing elements employed in this invention can be either negative-working or positive-working as indicated by the type of processing instructions (i.e. color negative, reversal, or direct positive processing) provided with the element. Suitable emulsions and their preparation as well as methods of chemical and spectral sensitization are described in Sections I through V. Various additives such as UV dyes, brighteners, antifoggants, stabilizers, light absorbing and scattering materials, and physical property modifying addenda such as hardeners, coating aids, plasticizers, lubricants and matting agents are described, for example, in Sections II and VI through VIII. Color materials are described in Sections X through XIII. Suitable methods for incorporating couplers and dyes, including dispersions in organic solvents, are described in Section X(E). Scan facilitating is described in Section XIV. Supports, exposure, development systems, and processing methods and agents are described in Sections XV to XX. The information contained in the September 1994 *Research Disclosure,* Item No. 36544 referenced above, is updated in the September 1996 *Research Disclosure,* Item No. 38957. Certain desirable photographic elements and processing steps, including those useful in conjunction with color reflective prints, are described in *Research Disclosure,* Item 37038, February 1995.

Coupling-off groups are well known in the art. Such groups can determine the chemical equivalency of a coupler, i.e., whether it is a 2-equivalent or a 4-equivalent coupler, or modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, or color correction.

The presence of hydrogen at the coupling site provides a 4-equivalent coupler, and the presence of another coupling-off group usually provides a 2-equivalent coupler. Representative classes of such coupling-off groups include, for example, chloro, alkoxy, aryloxy, hetero-oxy, sulfonyloxy, acyloxy, acyl, heterocyclyl, sulfonamido, mercaptotetrazole, benzothiazole, mercaptopropionic acid, phosphonyloxy, arylthio, and arylazo. These coupling-off groups are described in the art, for example, in U.S. Pat. Nos. 2,455,169, 3,227,551, 3,432,521, 3,476,563, 3,617,291, 3,880,661, 4,052,212 and 4,134,766; and in UK. Patents and published application Nos. 1,466,728, 1,531,927, 1,533,039, 2,006,755A and 2,017,704A, the disclosures of which are incorporated herein by reference.

Image dye-forming couplers may be included in the element such as couplers that form cyan dyes upon reaction with oxidized color developing agents which are described in such representative patents and publications as: "Farbkuppler-eine Literature Ubersicht," published in Agfa Mitteilungen, Band III, pp. 156–175 (1961) as well as in U.S. Pat. Nos. 2,367,531; 2,423,730; 2,474,293; 2,772,162; 2,895,826; 3,002,836; 3,034,892; 3,041,236; 4,333,999; 4,746,602; 4,753,871; 4,770,988; 4,775,616; 4,818,667; 4,818,672; 4,822,729; 4,839,267; 4,840,883; 4,849,328; 4,865,961; 4,873,183; 4,883,746; 4,900,656; 4,904,575; 4,916,051; 4,921,783; 4,923,791; 4,950,585; 4,971,898; 4,990,436; 4,996,139; 5,008,180; 5,015,565; 5,011,765; 5,011,766; 5,017,467; 5,045,442; 5,051,347; 5,061,613; 5,071,737; 5,075,207; 5,091,297; 5,094,938; 5,104,783; 5,178,993; 5,813,729; 5,187,057; 5,192,651; 5,200,305 5,202,224; 5,206,130; 5,208,141; 5,210,011; 5,215,871; 5,223,386; 5,227,287; 5,256,526; 5,258,270; 5,272,051; 5,306,610; 5,326,682; 5,366,856; 5,378,596; 5,380,638; 5,382,502; 5,384,236; 5,397,691; 5,415,990; 5,434,034; 5,441,863; EPO 0 246 616; EPO 0 250 201; EPO 0 271 323; EPO 0 295 632; EPO 0 307 927; EPO 0 333 185; EPO 0 378 898; EPO 0 389 817; EPO 0 487 111; EPO 0 488 248; EPO 0 539 034; EPO 0 545 300; EPO 0 556 700; EPO 0 556 777; EPO 0 556 858; EPO 0 569 979; EPO 0 608 133; EPO 0 636 936; EPO 0 651 286; EPO 0 690 344; German OLS 4,026,903; German OLS 3,624,777 and German OLS 3,823,049. Typically such couplers are phenols, naphthols, or pyrazoloazoles.

Couplers that form magenta dyes upon reaction with oxidized color developing agent are described in such representative patents and publications as: "Farbkuppler-eine Literature Ubersicht," published in Agfa Mitteilungen, Band III, pp. 126–156 (1961) as well as U.S. Pat. Nos. 2,311,082 and 2,369,489; 2,343,701; 2,600,788; 2,908,573; 3,062,653; 3,152,896; 3,519,429; 3,758,309; 3,935,015; 4,540,654; 4,745,052; 4,762,775; 4,791,052; 4,812,576; 4,835,094; 4,840,877; 4,845,022; 4,853,319; 4,868,099; 4,865,960; 4,871,652; 4,876,182; 4,892,805; 4,900,657; 4,910,124; 4,914,013; 4,921,968; 4,929,540; 4,933,465; 4,942,116; 4,942,117; 4,942,118; 4,959,480; 4,968,594; 4,988,614; 4,992,361; 5,002,864; 5,021,325; 5,066,575; 5,068,171; 5,071,739; 5,100,772; 5,110,942; 5,116,990; 5,118,812; 5,134,059; 5,155,016; 5,183,728; 5,234,805; 5,235,058; 5,250,400; 5,254,446; 5,262,292; 5,300,407; 5,302,496, 5,336,593; 5,350,667; 5,395,968; 5,354,826; 5,358,829; 5,368,998; 5,378,587; 5,409,808; 5,411,841; 5,418,123; 5,424,179; EPO 0 257 854; EPO 0 284 240; EPO 0 341 204; EPO 347,235; EPO 365,252; EPO 0 422 595; EPO 0 428 899; EPO 0 428 902; EPO 0 459 331; EPO 0 467 327; EPO 0 476 949; EPO 0 487 081; EPO 0 489 333; EPO 0 512 304; EPO 0 515 128; EPO 0 534 703; EPO 0 554 778; EPO 0 558 145; EPO 0 571 959; EPO 0 583 832; EPO 0 583 834; EPO 0 584 793; EPO 0 602 748; EPO 0 602 749; EPO 0 605 918; EPO 0 622 672; EPO 0 622 673; EPO 0 629 912; EPO 0 646 841, EPO 0 656 561; EPO 0 660 177; EPO 0 686 872; WO 90/10253; WO 92/09010; WO 92/10788; WO 92/12464; WO 93/01523; WO 93/02392; WO 93/02393; WO 93/07534; UK Application 2,244,053; Japanese Application 03192-350; German OLS 3,624,103; German OLS 3,912,265; and German OLS 40 08 067. Typically such couplers are pyrazolones, pyrazoloazoles, or pyrazolobenzimidazoles that form magenta dyes upon reaction with oxidized color developing agents.

Couplers that form yellow dyes upon reaction with oxidized color developing agent are described in such representative patents and publications as: "Farbkuppler-eine Literature Ubersicht," published in Agfa Mitteilungen; Band III; pp. 112–126 (1961); as well as U.S. Pat. No. 2,298,443; 2,407,210; 2,875,057; 3,048,194; 3,265,506; 3,447,928; 4,022,620; 4,443,536; 4,758,501; 4,791,050; 4,824,771; 4,824,773; 4,855,222; 4,978,605; 4,992,360; 4,994,361; 5,021,333; 5,053,325; 5,066,574; 5,066,576; 5,100,773; 5,118,599; 5,143,823; 5,187,055; 5,190,848; 5,213,958; 5,215,877; 5,215,878; 5,217,857; 5,219,716; 5,238,803; 5,283,166; 5,294,531; 5,306,609; 5,328,818; 5,336,591; 5,338,654; 5,358,835; 5,358,838; 5,360,713; 5,362,617; 5,382,506; 5,389,504; 5,399,474;. 5,405,737; 5,411,848; 5,427,898; EPO 0 327 976; EPO 0 296 793; EPO 0 365 282; EPO 0 379 309; EPO 0 415 375; EPO 0 437 818; EPO 0 447 969; EPO 0 542 463; EPO 0 568 037; EPO 0 568 196; EPO 0 568 777; EPO 0 570 006; EPO 0 573 761; EPO 0 608 956; EPO 0 608 957; and EPO 0 628 865. Such couplers are typically open chain ketomethylene compounds.

Couplers that form colorless products upon reaction with oxidized color developing agent are described in such representative patents as: UK. 861,138; U.S. Pat. Nos. 3,632,345; 3,928,041; 3,958,993 and 3,961,959. Typically such couplers are cyclic carbonyl containing compounds that form colorless products on reaction with an oxidized color developing agent.

Couplers that form black dyes upon reaction with oxidized color developing agent are described in such representative patents as U.S. Pat. Nos. 1,939,231; 2,181,944; 2,333,106; and 4,126,461; German OLS No. 2,644,194 and German OLS No. 2,650,764. Typically, such couplers are resorcinols or m-aminophenols that form black or neutral products on reaction with oxidized color developing agent.

In addition to the foregoing, so-called "universal" or "washout" couplers may be employed. These couplers do not contribute to image dye-formation. Thus, for example, a naphthol having an unsubstituted carbamoyl or one substituted with a low molecular weight substituent at the 2- or 3-position may be employed. Couplers of this type are described, for example, in U.S. Pat. Nos. 5,026,628, 5,151,343, and 5,234,800.

It may be useful to use a combination of couplers any of which may contain known ballasts or coupling-off groups such as those described in U.S. Pat. Nos. 4,301,235; 4,853,319 and 4,351,897. The coupler may contain solubilizing groups such as described in U.S. Pat. No. 4,482,629. The coupler may also be used in association with "wrong" colored couplers (e.g. to adjust levels of interlayer correction) and, in color negative applications, with masking couplers such as those described in EP 213.490; Japanese Published Application 58-172,647; U.S. Pat. Nos. 2,983,608; 4,070,191; and 4,273,861; German Applications DE 2,706,117 and DE 2,643,965; UK. Patent 1,530,272; and Japanese Application 58-113935. The masking couplers may be shifted or blocked, if desired.

The invention materials may be used in association with materials that release Photographically Useful Groups (PUGS) that accelerate or otherwise modify the processing steps e.g. of bleaching or fixing to improve the quality of the image. Bleach accelerator releasing couplers such as those described in EP 193,389; EP 301,477; U.S. Pat. Nos. 4,163, 669; 4,865,956; and 4,923,784, may be useful. Also contemplated is use of the compositions in association with nucleating agents, development accelerators or their precursors (UK Patent 2,097,140; UK. Patent 2,131,188); electron transfer agents (U.S. Pat. Nos. 4,859,578; 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The invention materials may also be used in combination with filter dye layers comprising yellow, cyan, and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. Nos. 4,420,556; and 4,543,323.) Also, the compositions may be blocked or coated in protected form as described, for example, in Japanese Application 61/258,249 or U.S. Pat. No. 5,019,492.

The invention materials may further be used in combination with image-modifying compounds that release PUGS such as "Developer Inhibitor-Releasing" compounds (DIRs). DIRs useful in conjunction with the compositions of the invention are known in the art and examples are described in U.S. Pat. Nos. 3,137,578; 3,148,022; 3,148, 062; 3,227,554; 3,384,657; 3,379,529; 3,615,506; 3,617, 291; 3,620,746; 3,701,783; 3,733,201; 4,049,455; 4,095, 984; 4,126,459; 4,149,886; 4,150,228; 4,211,562; 4,248, 962; 4,259,437; 4,362,878; 4,409,323; 4,477,563; 4,782, 012; 4,962,018; 4,500,634; 4,579,816; 4,607,004; 4,618, 571; 4,678,739; 4,746,600; 4,746,601; 4,791,049; 4,857, 447; 4,865,959; 4,880,342; 4,886,736; 4,937,179; 4,946, 767; 4,948,716; 4,952,485; 4,956,269; 4,959,299; 4,966, 835; 4,985,336 as well as in patent publications GB 1,560, 240; GB 2,007,662; GB 2,032,914; GB 2,099,167; DE 2,842,063, DE 2,937,127; DE 3,636,824; DE 3,644,416 as well as the following European Patent Publications: 272, 573; 335,319; 336,411; 346, 899; 362, 870; 365,252; 365, 346; 373,382; 376,212; 377,463; 378,236; 384,670; 396, 486; 401,612; 401,613.

Such compounds are also disclosed in "Developer-Inhibitor-Releasing (DIR) Couplers for Color Photography," C. R. Barr, J. R. Thirtle and P. W. Vittum in *Photographic Science and Engineering,* Vol. 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) that also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or group is selected from the following formulas:

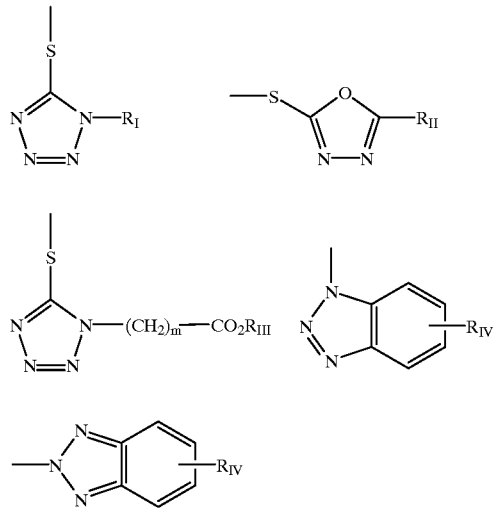

wherein $R_I$ is selected from the group consisting of straight and branched alkyls of from 1 to about 8 carbon atoms, benzyl, phenyl, and alkoxy groups and such groups containing none, one or more than one such substituent; $R_{II}$ is selected from $R_I$ and —$SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, —$COOR_V$ and —$NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

A compound such as a coupler may release a PUG directly upon reaction of the compound during processing, or indirectly through a timing or linking group. A timing group produces the time-delayed release of the PUG such groups using an intramolecular nucleophilic substitution reaction (U.S. Pat. No. 4,248,962); groups utilizing an electron transfer reaction along a conjugated system (U.S. Pat. Nos. 4,409,323; 4,421,845; 4,861,701, Japanese Applications 57-188035; 58-98728; 58-209736; 58-209738); groups that function as a coupler or reducing agent after the coupler reaction (U.S. Pat. Nos. 4,438,193; 4,618,571) and groups that combine the features described above. It is typical that the timing group is of one of the formulas:

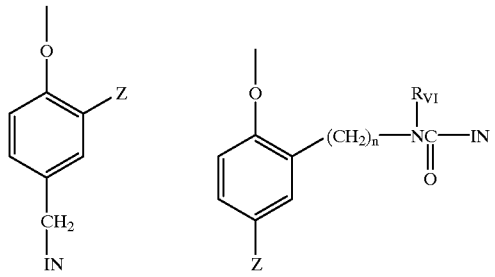

wherein IN is the inhibitor moiety, Z is selected from the group consisting of nitro, cyano, alkylsulfonyl; sulfamoyl ($—SO_2NR_2$); and sulfonamido ($—NRSO_2R$) groups; n is 0 or 1; and $R_{VI}$ is selected from the group consisting of substituted and unsubstituted alkyl and phenyl groups. The oxygen atom of each timing group is bonded to the coupling-off position of the respective coupler moiety of the DIAR.

The timing or linking groups may also function by electron transfer down an unconjugated chain. Linking groups are known in the art under various names. Often they have been referred to as groups capable of utilizing a hemiacetal or iminoketal cleavage reaction or as groups capable of utilizing a cleavage reaction due to ester hydrolysis such as U.S. Pat. No. 4,546,073. This electron transfer down an unconjugated chain typically results in a relatively fast decomposition and the production of carbon dioxide, formaldehyde, or other low molecular weight by-products. The groups are exemplified in EP 464,612, EP 523,451, U.S. Pat. No. 4,146,396, Japanese Kokai 60-249148 and 60-249149.

Suitable developer inhibitor-releasing couplers that may be included in photographic light sensitive emulsion layer include, but are not limited to, the following:

D1

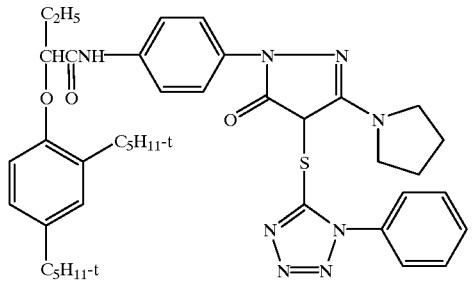

D2

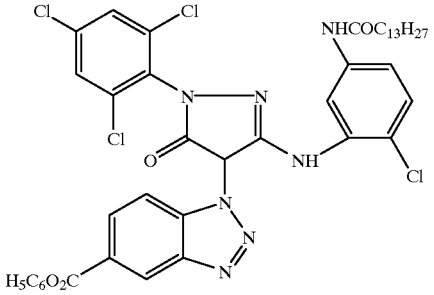

-continued

D3

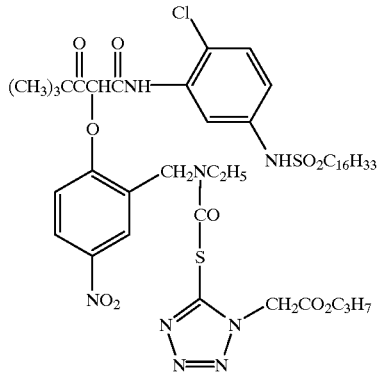

D4

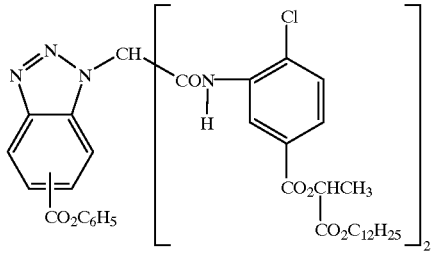

D5

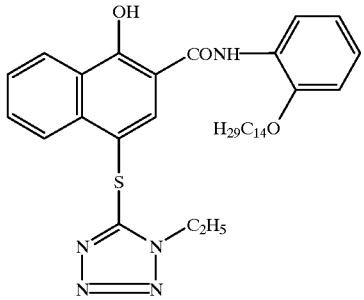

D6

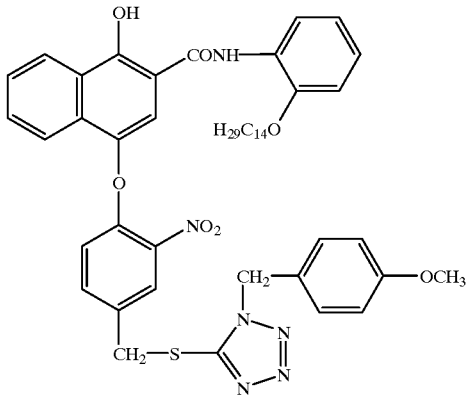

-continued
D7
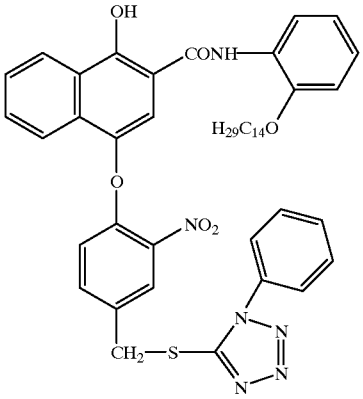
D8
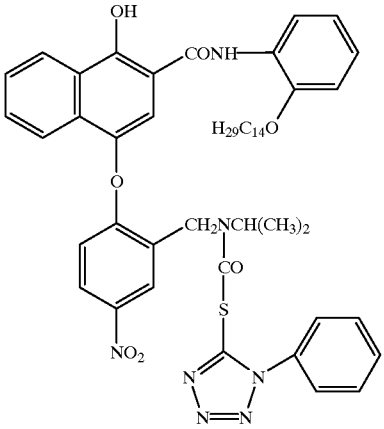
D9
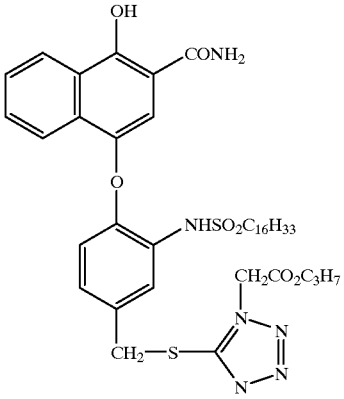
-continued
D10
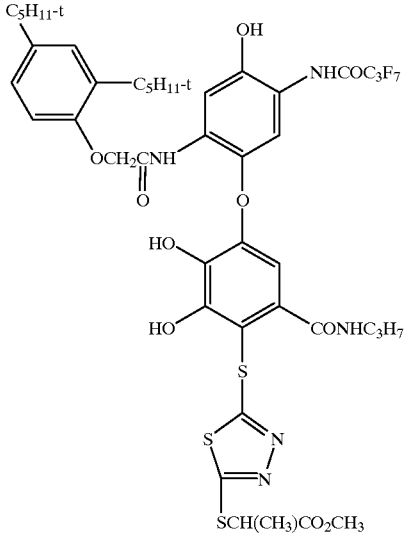
D11
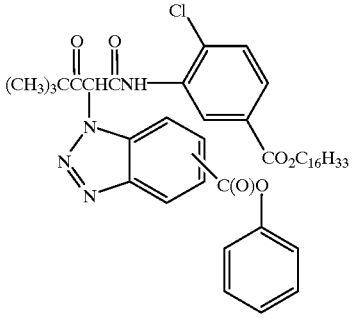
D12
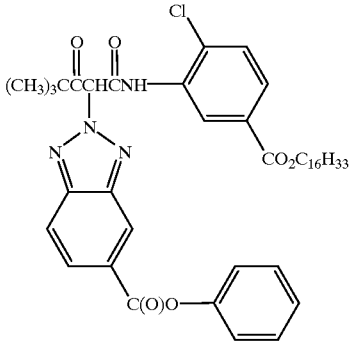

Especially useful in this invention are tabular grain silver halide emulsions. Tabular grains are those having two parallel major crystal faces and having an aspect ratio of at least 2. The term "aspect ratio" is the ratio of the equivalent circular diameter (ECD) of a grain major face divided by its thickness (t). The major faces of the tabular grains can lie in either {111} or {100} crystal planes. Specifically contemplated tabular grain emulsions are those in which greater than 50 percent of the total projected area of the emulsion grains are accounted for by tabular grains having a thickness of less than 0.3 micrometer (0.5 micrometer for blue sensitive emulsion) and an average tabularity (T) of greater than 25 (preferably greater than 100), where the term "tabularity" is employed in its art recognized usage as $$T=ECD/t^2$$

where ECD is the average equivalent circular diameter of the tabular grains in micrometers and t is the average thickness in micrometers of the tabular grains.

The average useful ECD of photographic emulsions can range up to about 10 micrometers, although in practice emulsion ECDs seldom exceed about 4 micrometers. Since both photographic speed and granularity increase with increasing ECDs, it is generally preferred to employ the smallest tabular grain ECDs compatible with achieving aim speed requirements.

Emulsion tabularity increases markedly with reductions in tabular grain thickness. It is generally preferred that aim tabular grain projected areas be satisfied by thin (t<0.2 micrometer) tabular grains. To achieve the lowest levels of granularity it is preferred that aim tabular grain projected areas be satisfied with ultrathin (t<0.07 micrometer) tabular grains. Tabular grain thicknesses typically range down to about 0.02 micrometer. However, still lower tabular grain thicknesses are contemplated. For example, Daubendiek et al. U.S. Pat. No. 4,672,027 reports a 3 mol percent iodide tabular grain silver bromoiodide emulsion having a grain thickness of 0.017 micrometer. Ultrathin tabular grain high chloride emulsions are disclosed by Maskasky U.S. Pat. No. 5,217,858.

As noted above tabular grains of less than the specified thickness account for at least 50 percent of the total grain projected area of the emulsion. To maximize the advantages of high tabularity it is generally preferred that tabular grains satisfying the stated thickness criterion account for the highest conveniently attainable percentage of the total grain projected area of the emulsion. For example, in preferred emulsions, tabular grains satisfying the stated thickness criteria above account for at least 70 percent of the total grain projected area. In the highest performance tabular grain emulsions, tabular grains satisfying the thickness criteria above account for at least 90 percent of total grain projected area.

Suitable tabular grain emulsions can be selected from among a variety of conventional teachings, such as those of the following Research Disclosure, Item 22534, January 1983, published by Kenneth Mason Publications, Ltd., Emsworth, Hampshire P010 7DD, England; U.S. Pat. Nos. 4,439,520; 4,414,310; 4,433,048; 4,643,966; 4,647,528; 4,665,012; 4,672,027; 4,678,745; 4,693,964; 4,713,320; 4,722,886; 4,755,456; 4,775,617; 4,797,354; 4,801,522; 4,806,461; 4,835,095; 4,853,322; 4,914,014; 4,962,015; 4,985,350; 5,061,069 and 5,061,616. Tabular grain emulsions consisting predominantly of silver chloride are useful and are described, for example, in U.S. Pat. Nos. 5,310,635; 5,320,938; and 5,356,764.

In their most widely used form tabular grain emulsions are high bromide {111} tabular grain emulsions. Such emulsions are illustrated by Kofron et al U.S. Pat. No. 4,439,520, Wilgus et al U.S. Pat. No. 4,434,226, Solberg et al U.S. Pat. No. 4,433,048, Maskasky U.S. Pat. Nos. 4,435,501, 4,463,087 and 4,173,320, Daubendiek et al U.S. Pat. Nos. 4,414,310 and 4,914,014, Sowinski et al U.S. Pat. No. 4,656,122, Piggin et al U.S. Pat. Nos. 5,061,616 and 5,061,609, Tsaur et al U.S. Pat. Nos. 5,147,771, 5,147,772, 5,147,773, 5,171,659 and 5,252,453, Black et al U.S. Pat. Nos. 5,219,720 and 5,334,495, Delton U.S. Pat. Nos. 5,310,644, 5,372,927 and 5,460,934, Wen U.S. Pat. No. 5,470,698, Fenton et al U.S. Pat. No. 5,476,760, Eshelman et al U.S. Pat. Nos. 5,612,175 and 5,614,359, and Irving et al U.S. Pat. No. 5,667,954.

Ultrathin high bromide {111} tabular grain emulsions are illustrated by Daubendiek et al U.S. Pat. Nos. 4,672,027, 4,693,964, 5,494,789, 5,503,971 and 5,576,168, Antoniades et al U.S. Pat. No. 5,250,403, Olm et al U.S. Pat. No. 5,503,970, Deaton et al U.S. Pat. No. 5,582,965, and Maskasky U.S. Pat. No. 5,667,955.

High bromide {100} tabular grain emulsions are illustrated by Mignot U.S. Pat. Nos. 4,386,156 and 5,386,156.

High chloride {111} tabular grain emulsions are illustrated by Wey U.S. Pat. No. 4,399,215, Wey et al U.S. Pat. No. 4,414,306, Maskasky U.S. Pat. Nos. 4,400,463, 4,713,323, 5,061,617, 5,178,997, 5,183,732, 5,185,239, 5,399,478 and 5,411,852, and Maskasky et al U.S. Pat. Nos. 5,176,992 and 5,178,998. Ultrathin high chloride {111} tabular grain emulsions are illustrated by Maskasky U.S. Pat. Nos. 5,271,858 and 5,389,509.

High chloride {100} tabular grain emulsions are illustrated by Maskasky U.S. Pat. Nos. 5,264,337, 5,292,632, 5,275,930 and 5,399,477, House et al U.S. Pat. No. 5,320,938, Brust et al U.S. Pat. No. 5,314,798, Szajewski et al U.S. Pat. No. 5,356,764, Chang et al U.S. Pat. Nos. 5,413,904 and 5,663,041, Oyamada U.S. Pat. No. 5,593,821, Yamashita et al U.S. Pat. Nos. 5,641,620 and 5,652,088, Saitou et al U.S. Pat. No. 5,652,089, and Oyamada et al U.S. Pat. No. 5,665,530. Ultrathin high chloride {100} tabular grain emulsions can be prepared by nucleation in the presence of iodide, following the teaching of House et al and Chang et al, cited above.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent. Tabular grain emulsions of the latter type are illustrated by Evans et al. U.S. Pat. No. 4,504,570.

Photographic elements can be exposed to actinic radiation, typically in the visible region of the spectrum, to form a latent image and can then be processed to form a visible dye image. Processing to form a visible dye image includes the step of contacting the element with a color-developing agent to reduce developable silver halide and oxidize the color developing agent. Oxidized color developing agent in turn reacts with the coupler to yield a dye.

With negative-working silver halide, the processing step described above provides a negative image. One type of such element, referred to as a color negative film, is designed for image capture. Speed (the sensitivity of the element to low light conditions) is usually critical to obtaining sufficient image in such elements. Such elements are typically silver bromoiodide emulsions and may be processed, for example, in known color negative processes such as the Kodak C-41™ process as described in The British Journal of Photography Annual of 1988, pages 191–198. If a color negative film element is to be subsequently employed to generate a viewable projection print as for a motion picture, a process such as the Kodak ECN-2™ process described in the H-24 Manual available from Eastman Kodak Co. may be employed to provide the color negative image on a transparent support. Color negative development times are typically 3 minutes 15 seconds. The photographic element of the invention can be incorporated into exposure structures intended for repeated use or exposure structures intended for limited use, variously referred to by names such as "single use cameras", "lens with film", or "photosensitive material package units".

A reversal element is capable of forming a positive image without optical printing. To provide a positive (or reversal) image, the color development step is preceded by development with a non-chromogenic developing agent to develop exposed silver halide, but not form dye, and followed by uniformly fogging the element to render unexposed silver halide developable. Such reversal emulsions are typically sold with instructions to process using a color reversal process such as the Kodak E-6™ process. Alternatively, a direct positive emulsion can be employed to obtain a positive image.

The above emulsions are typically sold with instructions to process using the appropriate method such as the mentioned color negative (Kodak C-41) or reversal (Kodak E-6) process.

Preferred color developing agents are p-phenylenediamines such as:

4-amino-N,N-diethylaniline hydrochloride,
4-amino-3-methyl-N,N-diethylaniline hydrochloride,
4-amino-3-methyl-N-ethyl-N-(2-methanesulfonamidoethyl) aniline sesquisulfate hydrate,
4-amino-3-methyl-N-ethyl-N-(2-hydroxyethyl)aniline sulfate,
4-amino-3-(2-methanesulfonamidoethyl)-N,N-diethylaniline hydrochloride, and
4-amino-N-ethyl-N-(2-methoxyethyl)-m-toluidine di-p-toluene sulfonic acid.

Of the above, developers based on 4-amino-3-methyl-N-ethyl-N-(2-hydroxyethyl)aniline and 4-amino-3-methyl-N-ethyl-N-(2-methanesulfonamidoethyl)aniline are especially preferred. The film elements of the invention can be processed with development times of less than 3.25 minutes or even less than 3 minutes or in extreme cases, even less than 120 seconds.

Development is usually followed by the conventional steps of bleaching, fixing, or bleach-fixing, to remove silver or silver halide, washing, and drying.

The entire contents of the patents and other publications referred to in this specification are incorporated herein by reference.

SYNTHESIS EXAMPLE

Preparation of MS-1

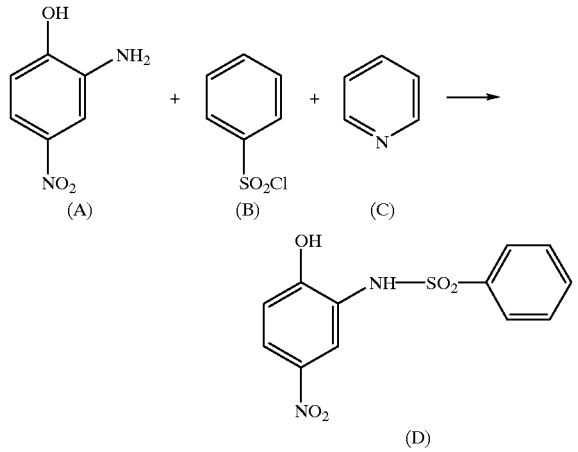

2-Amino-4-nitrophenol (154 g, 1 mole), pyridine (240 g, 3 mole) and 1 liter THF were mixed in a four neck 3 liter around bottom flask equipped with a mechanical stirrer and stirred until all compounds dissolved.

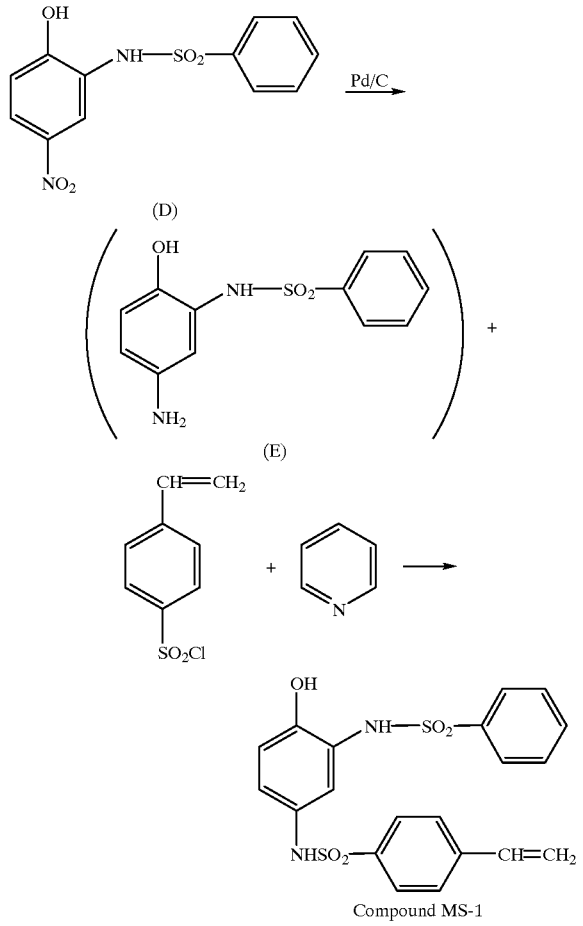

Compound MS-1

Benzenesulfonyl chloride (194 g, 1.1 mole) in 200 mL THF was added to the reactor over 30 minutes. The solution was stirred at room temperature overnight. A thick paste was obtained which was poured into 2 liter of 1N HCl solution.

Ethyl acetate was added to extract the product. The organic layer was washed with Sat. NaCl solution and then dried with magnesium sulfate. A pale yellow solid was obtained after solvent was evaporated. Crude yield was 245 g.

59 g of the above, 3 g of Pd/C, and 400 mL THF were mixed and hydrogenated (50 psi)overnight at room temperature. Pd/C was filtered and the filtrate was collected. TLC (ethyl acetate/dichloromethane=9:1) showed all starting material disappeared and one major product formed. The product was used without further purification. 47.46 g of pyridine was mixed with the above and the solution was transferred to a 2 liter 3-neck RB flask equipped with mechanical stirrer. 40.53 g of vinylbenzene sulfonyl chloride in 60 ml THF was added over 30 minutes to the flask at room temperature and stirred overnight.

Reddish solution was poured to a 1N HCL solution and ethyl acetate was added to extract the product Combined organic layer was dried over magnesium sulfate and the solvent was evaporated. Dichloromethane was added to the viscous residue and the desired compound MS-1 was isolated by column chromatography with dichloromethane/ethyl acetate(9/1 to 3/1) as elution solvent. 50 g of MS-1 was isolated and the structure was confirmed by NMR.

Preparation of Polymer P-1

8.6 g of MS-1, 2.57 g of n-butyl acrylate, 1.72 g of acrylic acid, 1.65 g of sodium styrene sulfonate, and 56 g of DMF were mixed in a 250 mL 3-neck RB flask equipped with a mechanical stirrer. The flask was immersed to a constant temperature bath at 80° C. and purged with nitrogen for 30 minutes. 0.14 g of AIBN in 1 mL DMF was added to initiate the polymerization. The polymerization was continued for 20 hours. An equal volume of methanol was added to the polymer solution and the polymer solution was dripped to 600 mL of hot distilled water with vigorous stirring to form the dispersion. The dispersion was cooled and dialyzed overnight against distilled water and concentrated. The % solid was 6.4% and the particle size measured by PCS was 126 nm.

Preparation of Polymer P-2

8.6 g of MS-1, 2.57 g of n-butyl acrylate, 1.72 g of acrylic acid, 0.86 g of sodium styrene sulfonate, and 56 g of DMF were mixed in a 250 mL 3-neck RB flask equipped with a mechanical stirrer. The flask was immersed to a constant temperature bath at 80° C. and purged with nitrogen for 30 minutes. 0.14 g of AIBN in 1 mL DMF was added to initiate the polymerization. The polymerization was continued for 20 hours. Equal volume of methanol was added to the polymer solution and the polymer solution was dripped to 600 mL of hot distilled water with vigorous stirring to form the dispersion. The dispersion was cooled and dialyzed overnight against distilled water and concentrated. The % solid was 8.0% and the particle size measured by PCS was 153 nm.

Photographic Examples

Formulas for the identified compounds are provided at the end of all of the examples.

Format A: Bichrome films demonstrating the invention were produced by coating the following layers over an antihalation layer with 2.48 of gelatin and 0.35 collodial grey silver on a cellulose triacetate film support (all coverages are in grams per meter squared):

Layer 1 (Overcoat): gelatin at 5.4 and bis-(vinylsulfonyl) methylether hardener at 0.24.

Layer 2 (Magenta Layer): gelatin at 2.69 and M-1 at 0.33.

Layer 3 (Interlayer): gelatin at 0.65.

Layer 4 (Yellow Layer): gelatin at 2.15, Y-1 at 1.08, red sensitized (with a mixture of RSD-1 and RSD-2) tabular silver iodobromide emulsion at 2.42 and 0.325 5-methyl-s-triazole-[2,3a]-pyrimidine-7-ol antifoggant.

Additional samples were prepared as above except the comparative or inventive samples were added directly to Layer 3 at 0.07 mmole/$m^2$ (based on disulfonamidphenol). CS-1 was dispersed in half its weight of N,N-diethyllauramide. The polymers were added directly. These samples were given a stepwise exposure and processed in the KODAK FLEXICOLOR™ (C41) process as described in British Journal of Photography Annual, 1988, pp196–198.

In this format, magenta dye can be formed only by the wandering of oxidized developer from the layer in which it was generated through an interlayer to the layer containing the magenta coupler. Thus the ability of the scavenger to prevent the oxidized developer from wandering can be measured by the difference in green density measured at minimum and maximum exposure. "Δ Green" is the (green density at Dmax—green density at Dmin) of the sample containing the scavenger minus (green density at Dmax—green density at Dmin) of the sample without scavenger. The more negative the value of "Δ Green", the more diffusion has been prevented. Thus, the more negative this value, the more efficient is the scavenger. "Δ Red" is the (red density at Dmin of the sample containing the scavenger) minus (red density at Dmin of the sample without scavenger) and is a measure of unwanted stain. Smaller numbers are preferred for these values.

TABLE 1

Polymers in Bichrome Format

| Sample | Comparative or Inventive | Scavenger in Layer 3 | Δ Green | Δ Red |
|---|---|---|---|---|
| A-1 | Comp | CS-1 | −0.175 | +0.024 |
| A-2 | Inv | P-1 | −0.240 | −0.005 |
| A-3 | Inv | P-2 | −0.223 | −0.009 |
| A-4 | Inv | P-3 | −0.239 | −0.005 |

The results shown in Table 1 clearly show that the inventive water dispersible polymers are more reactive and are not prone to red sensitizing dye stain compared to a typical ballasted disulfonamidophenol scavenger like CS-1.

Format B: Multilayer films demonstrating the principles of this invention were produced by coating the following layers on a cellulose triacetate film support (coverage are in grams per meter squared, emulsion sizes as determined by the disc centrifuge method and are reported in Diameter× Thickness in micrometers).

Layer 1 (Antihalation layer): black collodial silver sol at 0.140; gelatin at 2.15; DYE-1 at 0.049; DYE-2 at 0.017 and DYE-3 at 0.014.

Layer 2 (Slow cyan layer): a blend of three red sensitized (all with a mixture of RSD-1 and RSD-2) silver iodobromide emulsions: (i) a large sized tabular grain emulsion (1.3× 0.118, 4.1 mole % I) at 0.522 (ii) a smaller tabular emulsion (0.85×0.115, 4.1 mole % I) at 0.337 and (iii) a very small tabular grain emulsion (0.55×0.115, 1.5 mole % I) at 0.559; gelatin at 2.85; cyan dye-forming coupler C-1 at 0.452; DIR coupler DIR-1 at 0.043; bleach accelerator releasing coupler B-1 at 0.054 and anti-foggant 4-hydroxy-6-methyl-1,3,3a,7-tetraazaindene at 0.016.

Layer 3 (Fast cyan layer): a red-sensitized (same as above) tabular silver iodobromide emulsion (2.2×0.128, 4.1 mole % I) at 0.086; cyan coupler C-1 at 0.081; DIR-1 at 0.034; MC-1 at 0.043; gelatin at 1.72 and anti-foggant 4-hydroxy-6-methyl-1,3,3a,7-tetraazaindene at 0.010.

Layer 4 (Interlayer): gelatin at 1.29.

Layer 5 (Slow magenta layer): a blend of two green sensitized (both with a mixture of GSD-1 and GSD-2) silver iodobromide emulsions: (i) 0.54×0.091, 4.1 mole % iodide at 0.194 and (ii) 0.52×0.085, 1.5 mole % iodide at 0.559; M-2 at 0.238; gelatin at 1.08 and anti-foggant 4-hydroxy-6-methyl-1,3,3a,7-tetraazaindene at 0.005.

Layer 6 (Mid magenta layer): a blend of two green sensitized (same as above) tabular silver iodobromide emulsions (i) 1.3×0.113, 4.1 mole % I at 0.430 and (ii) 0.54×0.91, 4.1 mole % I at 0.172; M-2 at 0.065; MC-2 at 0.015; DIR-2 at 0.016; gelatin at 2.12 and anti-foggant 4-hydroxy-6-methyl-1,3,3a,7-tetraazaindene at 0.003.

Layer 7 (Fast magenta layer): a green sensitized tabular silver iodobromide (1.8×0.127, 4.1 mole % I) emulsion at 0.689; gelatin at 1.61; M-2 at 0.043; MC-2 at 0.054 and DIR-3 at 0.003.

Layer 8 (Yellow filter layer): gelatin at 0.86 and Carey-Lea silver at 0.043.

Layer 9 (Slow yellow layer): an equal blend of three blue sensitized (both with YSD-1) tabular silver iodobromide emulsions (i) 0.50×0.085, 1.5 mole % I (ii) 0.60 diameter, 3% mole I and (iii) 0.68 diameter, 3 mole % I at a total of 0.430; Y-2 at 0.216; Y-3 at 0.702; DIR-4 at 0.086; C-1 at 0.097 and gelatin at 2.066.

Layer 10 (Fast yellow layer): two blue sensitized (with YSD-1) tabular silver iodobromide emulsions (i) 3.1×0.137, 4.1 mole % I at 0.396 (ii) 0.95 diameter, 7.1 mole % I at 0.47; Y-2 at 0.216; Y-3 at 0.2238; DIR-4 at 0.075; C-1 at 0.011; B-1 at 0.008 and gelatin at 1.08.

Layer 11 (Protective overcoat and UV filter layer): gelatin at 1.61; silver bromide Lippman emulsion at 0.215; UV-1 and UV-2 (1:1 ratio) at a total of 0.023 and bis (vinylsulfonyl)methane hardener at 1.6% of total gelatin weight.

Surfactants, coating aids, emulsion addenda, sequestrants, lubricants, matte and tinting dyes were added to the appropriate layers as is common in the art. Sample B-2 is as above except OxDS-1 was added to Layer 1 at 0.108 and Layer 8 at 0.054. Sample B-3 is like B-2 except CS-1 replaces OxDS-1 in Layer 1 and 8 at the same laydown. Sample B-4 is like B-3 except an equimolar amount (based on disulfonamidophenol monomer) of P-3 replaces CS-1. These samples were given a stepwise neutral exposure and processed in the KODAK FLEXICOLOR™ (C41) process. Results are shown in Table 2.

TABLE 2

Polymeric Scavengers in Multilayer Format

| Sample | Scavenger | Blue Dmin | Green Dmin | Red Dmin |
|---|---|---|---|---|
| B-1 (Comp) | None | 0.843 | 0.764 | 0.349 |
| B-2 (Comp) | OxDS-1 | 0.821 | 0.681 | 0.279 |
| B-3 (Comp) | CS-1 | 0.815 | 0.661 | 0.313 |
| B-4 (Inv) | P-3 | 0.812 | 0.619 | 0.279 |

As seen in Table 2, addition of a hydroquinone scavenger as in B-2 improves the blue and green Dmin by preventing wandering of Dox between the blue and green layer (due to the presence of the scavenger in the interlayer between those layers) and improves the red Dmin by scavenging Dox generated due to solution physical development of the grey collodial silver in the antihalation layer. A ballasted disulfonamidophenol scavenger (which has improved oxidative stability relative to the hydroquinone scavenger) as in B-3 can prevent blue/green Dox wandering but causes additional red sensitizing dye stain. Only the inventive polymeric scavenger P-3 in Sample B-4 offers excellent oxidative stability, high activity towards Dox and low stain.

Formulas for materials used in the above formats are as follows:

Dye-1:

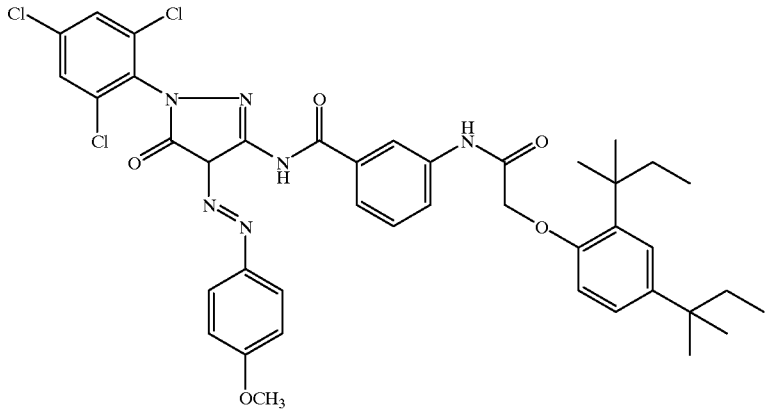

-continued
Dye-2:
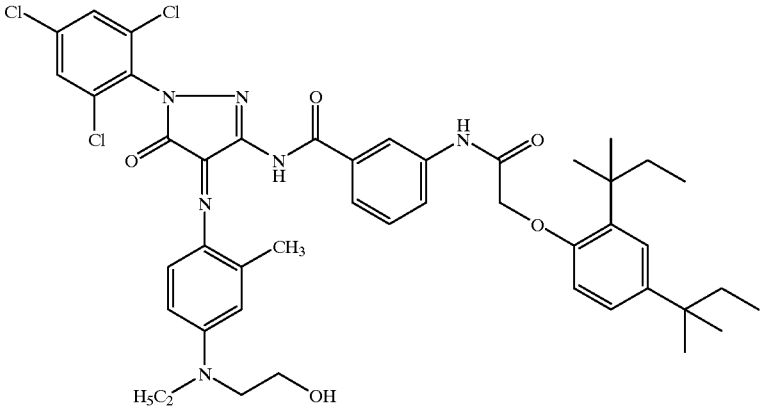
Dye-3:
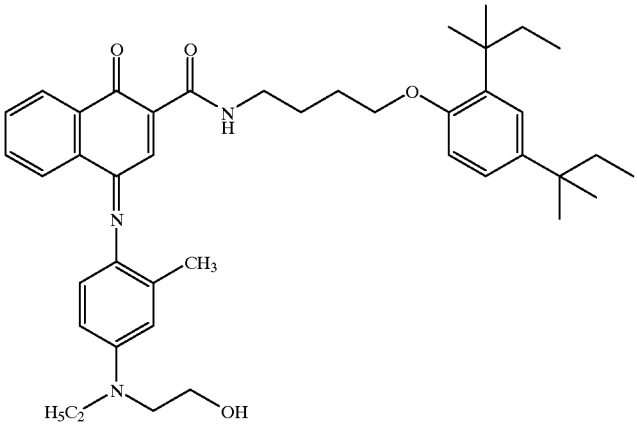
UV-1:
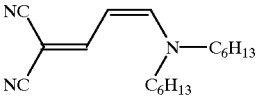
UV-2:
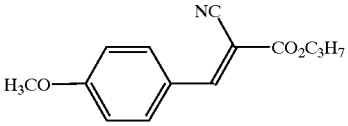
OxDS-1:
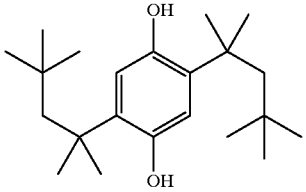
C-1:
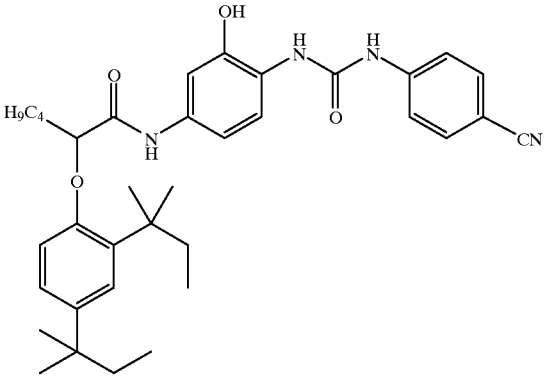

-continued
M-1:
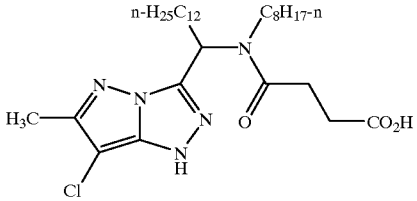
M-2:
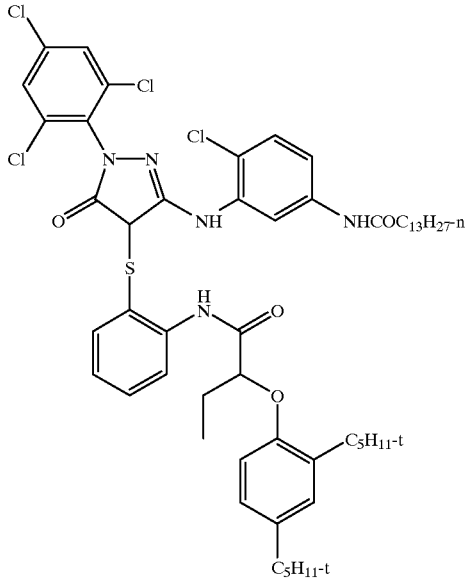
Y-1:
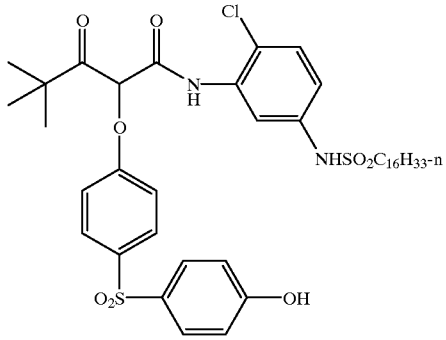
Y-2:
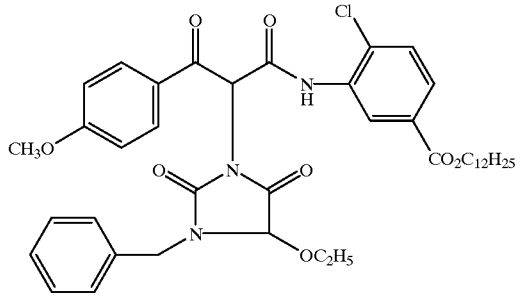
Y-3:
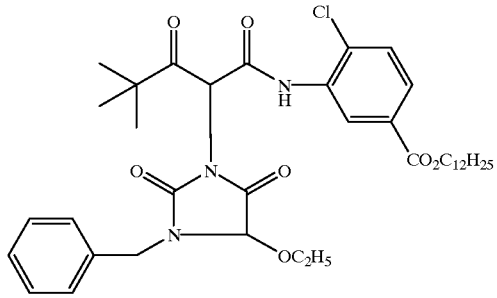
B-1:
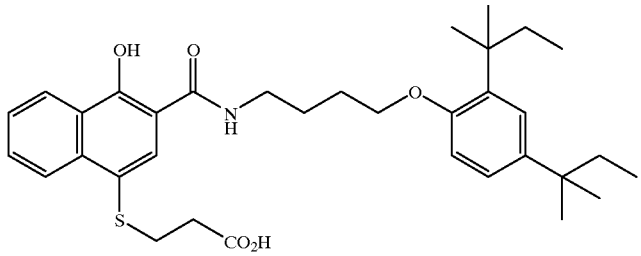

-continued
MC-1:
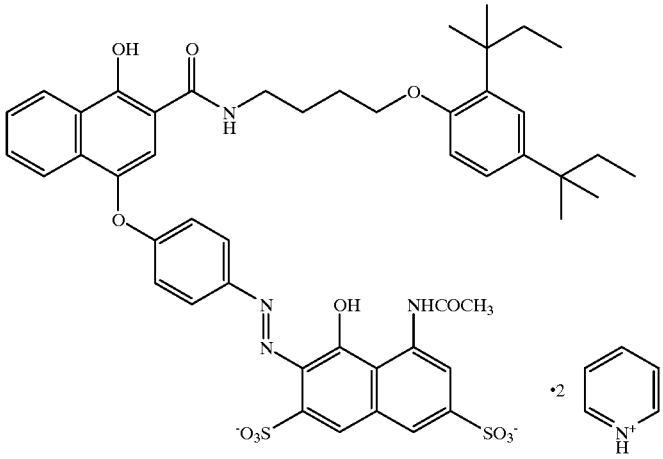
MC-2:
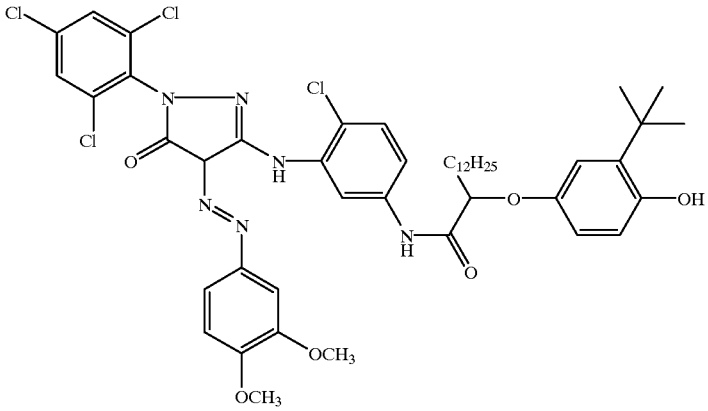
DIR-1:
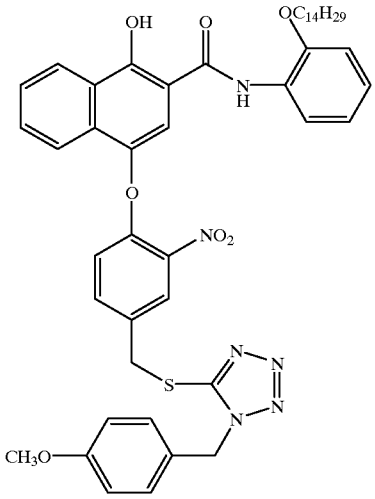
DIR-2:
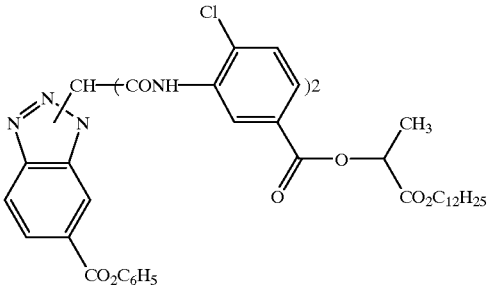

-continued

DIR-3:

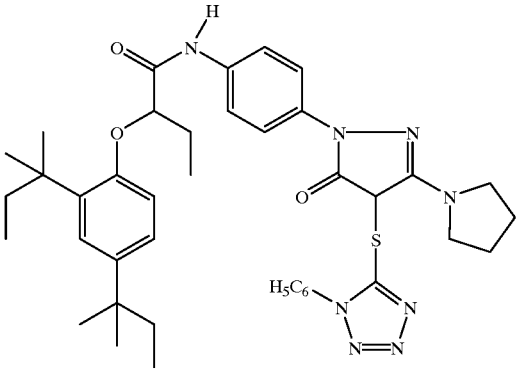

DIR-4:

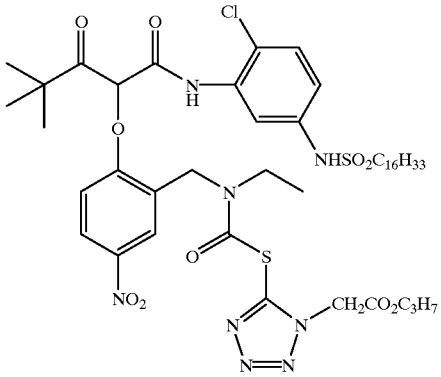

GSD-1:

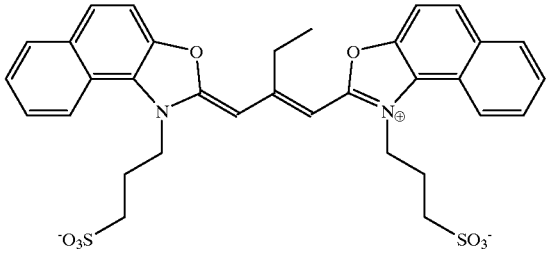

GSD-2:

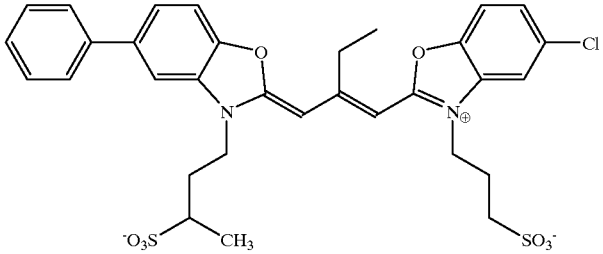

BSD-1:

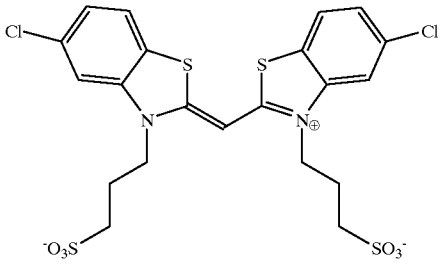

CS-1:

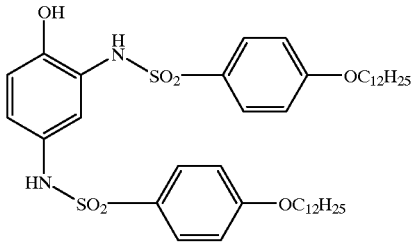

The invention has been described in detail with particular reference to preferred embodiments thereof, but it will be understood that variations and modifications can be effected within the scope and spirit of the invention.

What is claimed is:

1. A photographic element comprising a support, a radiation sensitive silver halide emulsion layer and a water dispersible polymeric disulfonamidophenol that is substantially immobile in the element.

2. The photographic element of claim 1 wherein the polymeric disulfonamidophenol contains sulfonic acid groups, carboxylic acid groups, phosphonic acid groups, or nitrogen acid groups having a pKa of 7.0 or less.

3. The photographic element of claim 2 wherein the polymeric disulfonamidophenol contains sulfonic or carboxylic acid groups.

4. The photographic element of claim 1 wherein the polymer has repeating units according to Formula A:

(A)

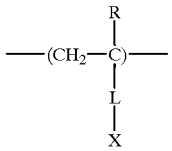

wherein:

R is hydrogen or an alkyl or aryl group; L is a divalent linking group; and X is a disulfonamidophenol.

5. The photographic element of claim 4 wherein the polymer additionally contains repeating units of an ionizable comonomer according to Formula (B):

(B)

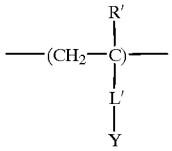

wherein R' is a hydrogen, or an alkyl or aryl group; L' is a divalent linking group; and Y is an ionizable subunit which is a sulfonate, sulfate, phosphate, carboxylate, thiosulfate or sulfinate.

6. The photographic element of claim 5 in which the polymer contains from 5 to 50 weight percent of the ionizable comonomer.

7. The photographic element of claim 4 wherein the disulfonamidophenol is according to Formula X-1:

(X-1)

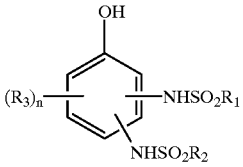

wherein $R_1$ and $R_2$ are alkyl, aryl, amino, —O-alkyl, —S-alkyl, —O-aryl or S-aryl groups and may be the same or different;

$R_3$ is an alkyl, aryl, alkoxy or aryloxy, alkylthio or arylthio, sulfoxyl, sulfonyl, sulfamoyl, sulfonic acid, fluoro, chloro, bromo or iodo, cyano, nitro, —O—CO—, —O—$SO_2$—, heterocyclic, carboxylic acid, carboxylate ester, carbamoyl or amino group; and n=0, 1, 2 or 3, and one of $R_1$, $R_2$ and $R_3$ is a L group that serves to attach the nucleus to the polymeric backbone.

8. The photographic element of claim 7 wherein the polymer additionally contains repeating units of an ionizable comonomer according to Formula (B):

(B)

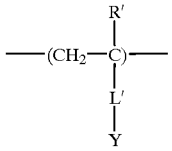

wherein R' is a hydrogen, or an alkyl or aryl group; L' is a divalent linking group; and Y is an ionizable subunit which is a sulfonate, sulfate, phosphate, carboxylate, thiosulfate or sulfinate.

9. The photographic element of claim 8 in which the polymer contains from 5 to 50 weight percent of the ionizable comonomer.

10. The photographic element of claim 7 wherein $R_1$ and $R_2$ are alkyl or aryl groups and n=0.

11. The photographic element of claim 10 wherein the polymer additionally contains repeating units of an ionizable comonomer according to Formula (B):

(B)

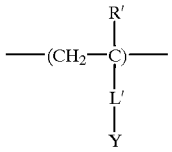

wherein R' is a hydrogen, or an alkyl or aryl group; L' is a divalent linking group; and Y is an ionizable subunit which is a sulfonate, sulfate, phosphate, carboxylate, thiosulfate or sulfinate.

12. The photographic element of claim 11 in which the polymer contains from 5 to 50 weight percent of the ionizable comonomer.

13. The photographic element of claim 1 wherein the solubility of the polymeric disulfonamidophenol in water is from 0.5% to 50.0% by weight at 25° C.

14. The photographic element of claim 13 wherein the solubility of the polymeric disulfonamidophenol in water is from 2.5% to 50.0% by weight at 25° C.

15. The photographic element of claim 5 wherein the solubility of the polymeric disulfonamidophenol in water is from 0.5% to 50.0% by weight at 25° C.

16. The photographic element of claim 15 wherein the solubility of the polymeric disulfonamidophenol in water is from 2.5% to 50.0% by weight at 25° C.

* * * * *